US009370696B2

(12) United States Patent
Tavares et al.

(10) Patent No.: US 9,370,696 B2
(45) **Date of Patent: *Jun. 21, 2016**

(54) GOLF CLUB ASSEMBLY AND GOLF CLUB WITH AERODYNAMIC FEATURES

(71) Applicant: NIKE, Inc., Beaverton, OR (US)

(72) Inventors: Gary G. Tavares, Southbridge, MA (US); Robert Boyd, Flower Mound, TX (US); John T. Stites, Sallisaw, TX (US); Andrew G. V. Oldknow, Beaverton, OR (US)

(73) Assignee: NIKE, Inc, Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/256,372

(22) Filed: Apr. 18, 2014

(65) Prior Publication Data

US 2014/0228147 A1 Aug. 14, 2014

Related U.S. Application Data

(63) Continuation of application No. 13/924,824, filed on Jun. 24, 2013, now Pat. No. 8,721,470, which is a continuation of application No. 13/544,735, filed on Jul. 9, 2012, now Pat. No. 8,485,917, which is a (Continued)

(51) Int. Cl.
*A63B 53/04* (2015.01)
*A63B 59/00* (2015.01)

(52) U.S. Cl.
CPC ..... *A63B 53/04* (2013.01); *A63B 53/0466* (2013.01); *A63B 60/52* (2013.01);

(Continued)

(58) Field of Classification Search
CPC ..... A63B 53/0466; A63B 49/06; A63B 2225/01; A63B 53/04; A63B 2059/0011; A63B 2053/0433; A63B 2060/006; A63B 60/52
USPC ..... 473/324–350, 287–292, 228; D21/752, D21/759
See application file for complete search history.

(56) References Cited

U.S. PATENT DOCUMENTS 1,396,470 A 11/1921 Taylor
1,587,758 A 6/1926 Charavay (Continued)

FOREIGN PATENT DOCUMENTS

GB 2212402 A 7/1989
GB 2310379 A 8/1997

(Continued)

OTHER PUBLICATIONS

ADAMSGOLF; Speedline Driver advertisement; Golf World Magazine; Mar. 9, 2009, p. 15.

(Continued)

*Primary Examiner* — Sebastiano Passaniti
(74) *Attorney, Agent, or Firm* — Banner & Witcoff, Ltd.

(57) ABSTRACT

A golf club head includes a body member having a ball striking face, a crown, a toe, a heel, a sole, and a skirt extending between the crown and the sole and between the toe and the heel. The club head includes a drag-reducing structure that may include one or both of a continuous groove extending from a front portion to a rear edge of the toe, and along an entire length of the skirt, and a substantially V-shaped recess formed in the sole and having a vertex positioned proximate the ball striking face and the heel and away from the skirt and the toe, and a pair of legs extending to a point proximate the toe and away from the ball striking face, and curving toward the skirt and away from the ball striking face.

17 Claims, 4 Drawing Sheets

Related U.S. Application Data continuation of application No. 13/427,211, filed on Mar. 22, 2012, now Pat. No. 8,398,505, which is a continuation of application No. 12/465,164, filed on May 13, 2009, now Pat. No. 8,162,775.

(52) U.S. Cl.

CPC . *A63B2053/0433* (2013.01); *A63B 2059/0011* (2013.01); *A63B 2060/006* (2013.01); *A63B 2225/01* (2013.01)

(56) References Cited

U.S. PATENT DOCUMENTS 1,671,956 A 5/1928 Sime
D92,266 S 5/1934 Nicoll et al.
2,051,083 A 8/1936 Hart
2,083,189 A 6/1937 Crooker
2,098,445 A 11/1937 Wettlaufer
D164,596 S 9/1951 Penna
2,592,013 A 4/1952 Curley
2,644,890 A 7/1953 Hollihan
2,998,254 A 8/1961 Rains et al.
D192,515 S 4/1962 Henrich
3,037,775 A 6/1962 Busch
3,468,544 A 9/1969 Antonious
D225,123 S 11/1972 Viero et al.
3,794,328 A 2/1974 Gordon
3,845,960 A 11/1974 Thompson
3,951,413 A 4/1976 Bilyeu
D239,964 S 5/1976 Wilson
3,976,299 A 8/1976 Lawrence et al.
3,979,122 A 9/1976 Belmont
3,993,314 A 11/1976 Harrington et al.
D243,706 S 3/1977 Hall
4,021,047 A 5/1977 Mader
D247,824 S 5/1978 Meissler
4,283,057 A 8/1981 Ragan
4,444,392 A 4/1984 Duclos
4,461,481 A 7/1984 Kim
D275,412 S 9/1984 Simmons
D275,590 S 9/1984 Duclos
4,541,631 A 9/1985 Sasse
4,630,827 A 12/1986 Yoneyama
4,635,375 A 1/1987 Tarcsafalvi
4,653,756 A 3/1987 Sato
4,655,458 A 4/1987 Lewandowski
4,754,974 A 7/1988 Kobayashi
D298,643 S 11/1988 Mitsui
4,809,982 A 3/1989 Kobayashi
4,850,593 A 7/1989 Nelson
4,874,171 A 10/1989 Ezaki et al.
D307,783 S 5/1990 Iinuma
4,930,783 A 6/1990 Antonious
D310,254 S 8/1990 Take et al.
4,951,953 A 8/1990 Kim
4,957,468 A 9/1990 Otsuka et al.
4,969,921 A 11/1990 Silvera
5,013,041 A 5/1991 Sun et al.
5,048,834 A 9/1991 Gorman
5,048,835 A 9/1991 Gorman
5,054,784 A 10/1991 Collins
5,074,563 A 12/1991 Gorman
5,082,279 A 1/1992 Hull et al.
D325,324 S 4/1992 Kahl
D326,130 S 5/1992 Chorne
D326,885 S 6/1992 Paul
D326,886 S 6/1992 Sun et al.
5,120,061 A 6/1992 Tsuchida et al.
D329,904 S 9/1992 Gorman
5,149,091 A 9/1992 Okumoto et al.
5,158,296 A 10/1992 Lee
5,190,289 A 3/1993 Nagai et al.
5,193,810 A 3/1993 Antonious
5,195,747 A 3/1993 Choy
5,203,565 A 4/1993 Murray et al.
5,221,086 A 6/1993 Antonious
5,230,510 A 7/1993 Duclos
5,240,252 A 8/1993 Schmidt et al.
5,244,210 A 9/1993 Au
D340,493 S 10/1993 Murray et al.
5,257,786 A * 11/1993 Gorman ..... 473/349
5,271,622 A 12/1993 Rogerson
5,280,923 A 1/1994 Lu
D345,403 S 3/1994 Sanchez
5,295,689 A 3/1994 Lundberg
5,318,297 A 6/1994 Davis et al.
5,318,300 A 6/1994 Schmidt et al.
D349,934 S 8/1994 Feche et al.
D350,176 S 8/1994 Antonious
D350,580 S 9/1994 Allen
D351,441 S 10/1994 Iinuma et al.
D352,324 S 11/1994 Sicaeros
5,366,222 A 11/1994 Lee
D354,782 S 1/1995 Gonzalez, Jr.
5,401,021 A 3/1995 Allen
5,411,255 A 5/1995 Kurashima et al.
5,411,264 A 5/1995 Oku
5,423,535 A 6/1995 Shaw et al.
5,435,558 A 7/1995 Iriarte
D362,039 S 9/1995 Lin
5,451,056 A 9/1995 Manning
D363,750 S 10/1995 Reed
5,456,469 A 10/1995 MacDougall
5,464,217 A 11/1995 Shenoha et al.
5,465,970 A 11/1995 Adams et al.
5,467,989 A 11/1995 Good et al.
5,478,075 A 12/1995 Saia et al.
5,486,000 A 1/1996 Chorne
5,497,995 A 3/1996 Swisshelm
5,505,448 A 4/1996 Park
5,511,786 A 4/1996 Antonious
5,511,788 A 4/1996 Manley et al.
5,518,240 A 5/1996 Igarashi
5,524,890 A 6/1996 Kim et al.
5,529,303 A 6/1996 Chen
D371,407 S 7/1996 Ritchie et al.
5,544,884 A 8/1996 Hardman
5,547,194 A 8/1996 Aizawa et al.
D374,899 S * 10/1996 Mahaffey ..... D21/752
5,575,722 A 11/1996 Saia et al.
5,575,725 A 11/1996 Olsavsky
5,580,321 A 12/1996 Rennhack
5,584,770 A 12/1996 Jensen
5,590,875 A 1/1997 Young
5,601,498 A 2/1997 Antonious
D379,390 S 5/1997 Watanabe et al.
5,628,697 A 5/1997 Gamble
5,632,691 A 5/1997 Hannon et al.
5,632,695 A 5/1997 Hlinka et al.
5,643,103 A 7/1997 Aizawa
5,643,107 A 7/1997 Gorman
5,665,014 A 9/1997 Sanford et al.
5,681,227 A 10/1997 Sayrizi
5,688,189 A 11/1997 Bland
5,697,855 A 12/1997 Aizawa
5,700,208 A 12/1997 Nelms
D389,886 S 1/1998 Kulchar et al.
D390,616 S 2/1998 Maltby
5,720,674 A 2/1998 Galy
5,735,754 A 4/1998 Antonious
5,776,009 A 7/1998 McAtee
5,785,609 A 7/1998 Sheets et al.
5,788,584 A 8/1998 Parente et al.
D398,681 S 9/1998 Galy
5,803,829 A 9/1998 Hayashi
5,803,830 A 9/1998 Austin et al.
5,807,187 A 9/1998 Hamm
D399,279 S 10/1998 Jackson
5,833,551 A 11/1998 Vincent et al.
5,839,975 A 11/1998 Lundberg
5,873,791 A 2/1999 Allen
5,873,793 A 2/1999 Swinford
5,885,170 A 3/1999 Takeda
5,899,818 A 5/1999 Zider et al.

(56) References Cited

U.S. PATENT DOCUMENTS 5,908,357 A 6/1999 Hsieh
5,913,733 A 6/1999 Bamber
5,921,870 A 7/1999 Chiasson
5,931,742 A 8/1999 Nishimura et al.
5,938,540 A 8/1999 Lu
5,941,782 A 8/1999 Cook
5,954,595 A 9/1999 Antonious
5,961,397 A 10/1999 Lu et al.
5,967,903 A 10/1999 Cheng
5,976,033 A 11/1999 Takeda
5,980,394 A 11/1999 Domas
5,997,413 A 12/1999 Wood, IV
5,997,415 A 12/1999 Wood
6,017,280 A 1/2000 Hubert
6,027,414 A 2/2000 Koebler
6,027,415 A 2/2000 Takeda
D421,472 S 3/2000 Peterson
D422,659 S 4/2000 Mertens
6,059,669 A 5/2000 Pearce
6,074,308 A 6/2000 Domas
6,077,171 A 6/2000 Yoneyama
6,123,627 A 9/2000 Antonious
6,149,534 A 11/2000 Peters et al.
6,165,080 A 12/2000 Salisbury
D436,149 S 1/2001 Helmstetter et al.
6,251,028 B1 6/2001 Jackson
6,277,032 B1 8/2001 Smith
D447,783 S 9/2001 Glod
6,296,576 B1 10/2001 Capelli
6,302,813 B1 10/2001 Sturgeon et al.
6,319,148 B1 11/2001 Tom
D454,606 S 3/2002 Helmstetter et al.
6,368,234 B1 4/2002 Galloway
6,379,262 B1 4/2002 Boone
6,422,951 B1 7/2002 Burrows
6,471,603 B1 10/2002 Kosmatka
6,471,604 B2 10/2002 Hocknell et al.
6,482,106 B2 11/2002 Saso
D470,202 S 2/2003 Tunno
6,530,847 B1 3/2003 Antonious
6,558,271 B1 5/2003 Beach et al.
6,561,922 B2 5/2003 Bamber
6,569,029 B1 5/2003 Hamburger
6,572,489 B2 6/2003 Miyamoto et al.
6,575,845 B2 6/2003 Smith et al.
6,575,854 B1 6/2003 Yang et al.
6,609,981 B2 8/2003 Hirata
6,623,378 B2 9/2003 Beach et al.
D481,430 S 10/2003 Tunno
6,641,490 B2 11/2003 Ellemor
6,716,114 B2 4/2004 Nishio
6,733,359 B1 5/2004 Jacobs
6,739,983 B2 5/2004 Helmstetter et al.
6,773,359 B1 8/2004 Lee
6,776,725 B1 8/2004 Miura et al.
D498,507 S 11/2004 Gamble
D498,508 S 11/2004 Antonious
D499,155 S 11/2004 Imamoto
6,824,474 B1 11/2004 Thill
6,825,315 B2 11/2004 Aubert
D502,232 S 2/2005 Antonious
6,855,068 B2 2/2005 Antonious
D502,751 S 3/2005 Lukasiewicz
6,860,818 B2 3/2005 Mahaffey et al.
6,890,267 B2 5/2005 Mahaffey et al.
6,929,563 B2 8/2005 Nishitani
D509,869 S 9/2005 Mahaffey
D515,642 S 2/2006 Antonious
D515,643 S 2/2006 Ortiz
7,025,692 B2 4/2006 Erickson et al.
7,121,956 B2 10/2006 Lo
7,128,662 B2 10/2006 Kumamoto
7,128,664 B2 10/2006 Onoda et al.
7,147,580 B2 12/2006 Nutter et al.
7,163,468 B2 1/2007 Gibbs et al.
7,175,541 B2 2/2007 Lo
D537,895 S * 3/2007 Breier et al. ..... D21/752
7,261,641 B2 8/2007 Lindner
D564,611 S 3/2008 Llewellyn et al.
7,351,161 B2 4/2008 Beach
7,390,266 B2 6/2008 Gwon
7,390,271 B2 6/2008 Yamamoto
7,481,716 B1 1/2009 Johnson
D589,107 S 3/2009 Oldknow
D589,576 S 3/2009 Kadoya
7,500,924 B2 3/2009 Yokota
7,524,249 B2 4/2009 Breier et al.
D592,714 S 5/2009 Lee
7,559,854 B2 7/2009 Harvell et al.
D598,510 S * 8/2009 Barez et al. ..... D21/752
7,568,985 B2 8/2009 Beach et al.
7,578,754 B2 8/2009 Nakamura
7,601,078 B2 10/2009 Mergy et al.
D606,144 S 12/2009 Kim et al.
D608,850 S 1/2010 Oldknow
7,641,568 B2 1/2010 Hoffman et al.
D609,296 S 2/2010 Oldknow
D609,297 S 2/2010 Oldknow
D609,300 S 2/2010 Oldknow
D609,764 S 2/2010 Oldknow
7,658,686 B2 2/2010 Soracco
7,682,264 B2 3/2010 Hsu et al.
7,682,267 B2 3/2010 Libonati
7,699,718 B2 4/2010 Lindner
7,704,160 B2 4/2010 Lindner
7,704,161 B2 4/2010 Lindner
7,713,138 B2 5/2010 Sato et al.
7,717,807 B2 5/2010 Evans et al.
7,803,065 B2 9/2010 Breier et al.
7,922,595 B2 4/2011 Libonati
8,133,135 B2 3/2012 Stites et al.
D657,838 S 4/2012 Oldknow
D658,252 S 4/2012 Oldknow
8,162,775 B2 4/2012 Tavares et al.
D659,781 S 5/2012 Oldknow
D659,782 S 5/2012 Oldknow
D660,931 S 5/2012 Oldknow
8,177,658 B1 5/2012 Johnson
8,177,659 B1 5/2012 Ehlers
8,182,364 B2 5/2012 Cole et al.
8,221,260 B2 7/2012 Stites et al.
8,226,501 B2 7/2012 Stites et al.
8,353,784 B2 1/2013 Boyd et al.
8,366,565 B2 2/2013 Tavares et al.
8,398,505 B2 3/2013 Tavares et al.
8,444,502 B2 5/2013 Karube
8,485,917 B2 7/2013 Tavares et al.
8,678,946 B2 3/2014 Boyd et al.
8,721,470 B2 * 5/2014 Tavares et al. ..... 473/327
8,753,224 B1 6/2014 Kim
8,821,311 B2 9/2014 Tavares et al.
2001/0001774 A1 5/2001 Antonious
2001/0027139 A1 10/2001 Saso
2002/0072433 A1 6/2002 Galloway et al.
2002/0077194 A1 6/2002 Carr et al.
2002/0077195 A1 6/2002 Carr et al.
2002/0082108 A1 6/2002 Peters et al.
2002/0121031 A1 9/2002 Smith et al.
2003/0017884 A1 1/2003 Masters et al.
2003/0087710 A1 5/2003 Sheets et al.
2003/0087719 A1 5/2003 Usoro et al.
2003/0157995 A1 8/2003 Mahaffey
2003/0220154 A1 11/2003 Anelli
2003/0232659 A1 12/2003 Mahaffey et al.
2003/0236131 A1 12/2003 Burrows
2004/0009824 A1 1/2004 Shaw
2004/0009829 A1 1/2004 Kapilow
2004/0018891 A1 1/2004 Antonious
2004/0138002 A1 7/2004 Murray
2004/0157678 A1 8/2004 Kohno
2004/0229713 A1 11/2004 Helmstetter et al.
2005/0009622 A1 1/2005 Antonious
2005/0020379 A1 1/2005 Kumamoto
2005/0026723 A1 2/2005 Kumamoto

(56) References Cited

U.S. PATENT DOCUMENTS

| | | | |
|---|---|---|---|
| 2005/0032584 | A1 | 2/2005 | Van Nimwegen |
| 2005/0049073 | A1 | 3/2005 | Herber |
| 2005/0054459 | A1 | 3/2005 | Oldenburg |
| 2005/0107183 | A1 | 5/2005 | Takeda et al. |
| 2005/0119068 | A1 | 6/2005 | Onoda et al. |
| 2005/0153798 | A1 | 7/2005 | Rigoli |
| 2005/0153799 | A1 | 7/2005 | Rigoli |
| 2005/0215350 | A1 | 9/2005 | Reyes et al. |
| 2005/0221914 | A1 | 10/2005 | Ezaki et al. |
| 2005/0221915 | A1 | 10/2005 | De Shiell et al. |
| 2005/0233831 | A1 | 10/2005 | Ezaki et al. |
| 2005/0245329 | A1 | 11/2005 | Nishitani et al. |
| 2005/0250594 | A1 | 11/2005 | Nishitani et al. |
| 2005/0261079 | A1 | 11/2005 | Qualizza |
| 2006/0000528 | A1 | 1/2006 | Galloway |
| 2006/0014588 | A1 | 1/2006 | Page |
| 2006/0054438 | A1 | 3/2006 | Asaba et al. |
| 2006/0079349 | A1 | 4/2006 | Rae et al. |
| 2006/0148588 | A1 | 7/2006 | Gibbs et al. |
| 2006/0252576 | A1 | 11/2006 | Lo |
| 2006/0281582 | A1 | 12/2006 | Sugimoto |
| 2006/0293114 | A1 | 12/2006 | Chen |
| 2006/0293120 | A1 | 12/2006 | Cackett et al. |
| 2007/0026965 | A1 | 2/2007 | Huang |
| 2007/0049407 | A1 | 3/2007 | Tateno et al. |
| 2007/0093315 | A1 | 4/2007 | Kang |
| 2007/0149310 | A1 | 6/2007 | Bennett et al. |
| 2007/0161433 | A1 | 7/2007 | Yokota |
| 2007/0293341 | A1 | 12/2007 | Jeong |
| 2008/0009364 | A1 | 1/2008 | Chen |
| 2008/0039228 | A1 | 2/2008 | Breier et al. |
| 2008/0102985 | A1 | 5/2008 | Chen |
| 2008/0113825 | A1 | 5/2008 | Funayama et al. |
| 2008/0139339 | A1 | 6/2008 | Cheng |
| 2008/0146374 | A1 | 6/2008 | Beach et al. |
| 2008/0188320 | A1 | 8/2008 | Kamatari |
| 2008/0242444 | A1 | 10/2008 | Park et al. |
| 2009/0048035 | A1 | 2/2009 | Stites et al. |
| 2009/0075751 | A1 | 3/2009 | Gilbert et al. |
| 2009/0082135 | A1 | 3/2009 | Evans et al. |
| 2009/0098949 | A1 | 4/2009 | Chen |
| 2009/0124410 | A1 | 5/2009 | Rife |
| 2009/0149276 | A1 | 6/2009 | Golden et al. |
| 2009/0203465 | A1 | 8/2009 | Stites et al. |
| 2009/0239681 | A1 | 9/2009 | Sugimoto |
| 2009/0286618 | A1 | 11/2009 | Beach et al. |
| 2010/0022325 | A1 | 1/2010 | Doran |
| 2010/0041490 | A1 | 2/2010 | Boyd et al. |
| 2010/0056298 | A1 | 3/2010 | Jertson et al. |
| 2010/0105498 | A1 | 4/2010 | Johnson |
| 2010/0184526 | A1 | 7/2010 | Park |
| 2010/0234126 | A1 | 9/2010 | Cackett et al. |
| 2010/0292020 | A1 | 11/2010 | Tavares et al. |
| 2010/0311517 | A1 | 12/2010 | Tavares et al. |
| 2011/0009209 | A1 | 1/2011 | Llewellyn et al. |
| 2011/0118051 | A1 | 5/2011 | Thomas |
| 2011/0136584 | A1 | 6/2011 | Boyd et al. |
| 2011/0281663 | A1 | 11/2011 | Stites et al. |
| 2011/0281664 | A1 | 11/2011 | Boyd et al. |
| 2012/0142452 | A1 | 6/2012 | Burnett et al. |
| 2012/0149494 | A1 | 6/2012 | Takahashi et al. |
| 2012/0178548 | A1 | 7/2012 | Tavares et al. |
| 2012/0196701 | A1 | 8/2012 | Stites et al. |
| 2012/0252597 | A1 | 10/2012 | Thomas |
| 2012/0277026 | A1 | 11/2012 | Tavares et al. |

FOREIGN PATENT DOCUMENTS

| | | | |
|---|---|---|---|
| JP | 3023452 | U | 4/1996 |
| JP | 2008-266692 | | 10/1996 |
| JP | 2009-262324 | | 10/1997 |
| JP | 2011-47316 | | 2/1999 |
| JP | H11-164723 | A | 6/1999 |
| JP | 2000-042150 | A | 2/2000 |
| JP | 3023452 | B2 | 3/2000 |
| JP | 2000229139 | A | 8/2000 |
| JP | 2001-212267 | A | 8/2001 |
| JP | 2002-291947 | A | 10/2002 |
| JP | 2002291947 | A | 10/2002 |
| JP | 2004/052474 | A | 2/2004 |
| JP | 2004159854 | A | 6/2004 |
| JP | 2005-237535 | A | 9/2005 |
| JP | 2006-116002 | A | 5/2006 |
| JP | 2007044148 | A | 2/2007 |
| JP | 2007-054198 | A | 3/2007 |
| JP | 2007-117728 | A | 5/2007 |
| JP | 2007-190077 | A | 8/2007 |
| JP | 2008-136861 | A | 6/2008 |
| JP | 2009-11366 | | 1/2009 |
| JP | 2009000281 | A | 1/2009 |
| JP | 2009-022571 | A | 2/2009 |
| JP | 2009540933 | A | 11/2009 |
| JP | 2009-279145 | A | 12/2009 |
| JP | 2009-279373 | A | 12/2009 |
| JP | 2011-528263 | A | 11/2011 |
| JP | 05-337220 | B2 | 11/2013 |
| TW | 405427 | U | 9/2000 |
| TW | 444601 | U | 7/2001 |
| WO | 9922824 | A1 | 5/1999 |
| WO | 2004022171 | A1 | 3/2004 |
| WO | 2004052474 | A1 | 6/2004 |
| WO | 2006073930 | A2 | 7/2006 |
| WO | 2008157655 | A1 | 12/2008 |
| WO | 2008157691 | A2 | 12/2008 |
| WO | 2010028114 | A2 | 3/2010 |
| WO | 2010104898 | A2 | 9/2010 |

OTHER PUBLICATIONS

Achenbach, James; Pros Test New Nike Driver; Golfweek, Oct. 3, 2009; http://www.golfweek.com/news/2009/oct/12/pros-test-new-nike-drivers/.

PING Go if Clubs: Rapture V2 Technology and Iron Specifications. Printed Feb. 11, 2009: D 1 1 http://www.ping.com/clubs/ironsdetaiLaspx?id=3652.

Rendall, Jeffrey A., Taylor Made RAC Irons—Finer Sounds Produces Less Fury, GolftheMidAtlantic.com, printed Sep. 24, 2010, 7 pages. http://www .golfthemidatlantic. com/story /232.

FT Hybrids Overview, CallawayGolf.com, printed Sep. 24, 2010, 2 pages. http:lwww"callawaygolf.corn/Giobal/en-US/Products/Ciubs/Hybrids/FTHybrids.html.

X-22 Irons Overview, CallawayGolf.corn, printed Sep. 24, 2010, 2 pages. http:i/www"callawaygolf.com/Giobal!en-US/ProductsiCiubs/IronsiX-221rons.html.

English Translation of JP Reasons for Rejection issued in JP Application No. 2013-501264, May 8, 2013.

* cited by examiner

GOLF CLUB ASSEMBLY AND GOLF CLUB WITH AERODYNAMIC FEATURES

RELATED APPLICATIONS

This U.S. patent application is a continuation application of and claims priority to U.S. patent application Ser. No. 13/924,824, filed Jun. 24, 2013, to "Golf Club Assembly and Golf Club With Aerodynamic Features," to Tavares et al., which is a continuation application of and claims priority to U.S. patent application Ser. No. 13/544,735, filed Jul. 9, 2012, to "Golf Club Assembly and Golf Club With Aerodynamic Features," to Tavares et al., which is a continuation application of and claims priority to U.S. patent application Ser. No. 13/427,211, filed Mar. 22, 2012, now U.S. Pat. No. 8,398,505 issued Mar. 19, 2013, to "Golf Club Assembly and Golf Club With Aerodynamic Features," to Tavares et al., which is a continuation application of and claims priority to U.S. patent application Ser. No. 12/465,164, filed May 13, 2009, now U.S. Pat. No. 8,162,775 issued Apr. 24, 2012, all of which are entirely incorporated herein by reference.

FIELD

Aspects of this invention relate generally to golf clubs and golf club heads, and, in particular, to a golf club and golf club head with aerodynamic features.

BACKGROUND

The distance a golf ball travels when struck by a golf club is determined in large part by club head speed at the point of impact with the golf ball. Club head speed in turn can be affected by the wind resistance or drag provided by the club head, especially given the large club head size of a driver. The club head of a driver, fairway wood, or metal wood in particular produces significant aerodynamic drag during its swing path. The drag produced by the club head leads to reduced club head speed and, therefore, reduced distance of travel of the golf ball after it has been struck.

Reducing the drag of the club head not only at the point of impact, but also during the swing up until the point of impact with the golf ball, would result in improved club head speed and increased distance of travel of the golf ball. It would be desirable to provide a golf club head that reduces or overcomes some or all of the difficulties inherent in prior known devices. Particular advantages will be apparent to those skilled in the art, that is, those who are knowledgeable or experienced in this field of technology, in view of the following disclosure of the invention and detailed description of certain embodiments.

SUMMARY

The principles of the invention may be used to provide a golf club head with improved aerodynamic performance. In accordance with a first aspect, a golf club head includes a body member having a ball striking face, a toe, a heel, a sole, and a skirt extending between the crown and the sole and between the toe and the heel. A drag reducing structure on the body member is configured to reduce drag for the body member during a golf swing from an end of a backswing through a downswing.

In accordance with another aspect, a golf club head includes a body member having a ball striking face, a toe, a heel, a sole, and a skirt extending between the crown and the sole and between the toe and the heel. A substantially V-shaped recess is formed in the sole and has a vertex positioned proximate the ball striking face and the heel and away from the skirt and the toe. A pair of legs extends to a point proximate the toe and away from the ball striking face, and curves toward the skirt and away from the ball striking face.

In accordance with a further aspect, a golf club assembly includes a shaft and a club head secured to a first end of the shaft. The club head includes a body member having a ball striking face, a toe, a heel, a sole, and a skirt extending between the crown and the sole and between the toe and the heel. A continuous groove extends from a front portion to a rear edge of the toe, and along an entire length of the skirt.

By providing a golf club head with a continuous groove extending from a front portion to a rear edge of the toe, and along an entire length of the skirt according to certain embodiments, the drag of the golf club head during its forward swing up until the point of impact with the golf ball can be reduced. This is highly advantageous since the reduced drag will lead to increased club head speed and, therefore, increased distance of travel of the golf ball after being struck by the club head.

These and additional features and advantages disclosed here will be further understood from the following detailed disclosure of certain embodiments.

Figure 1:
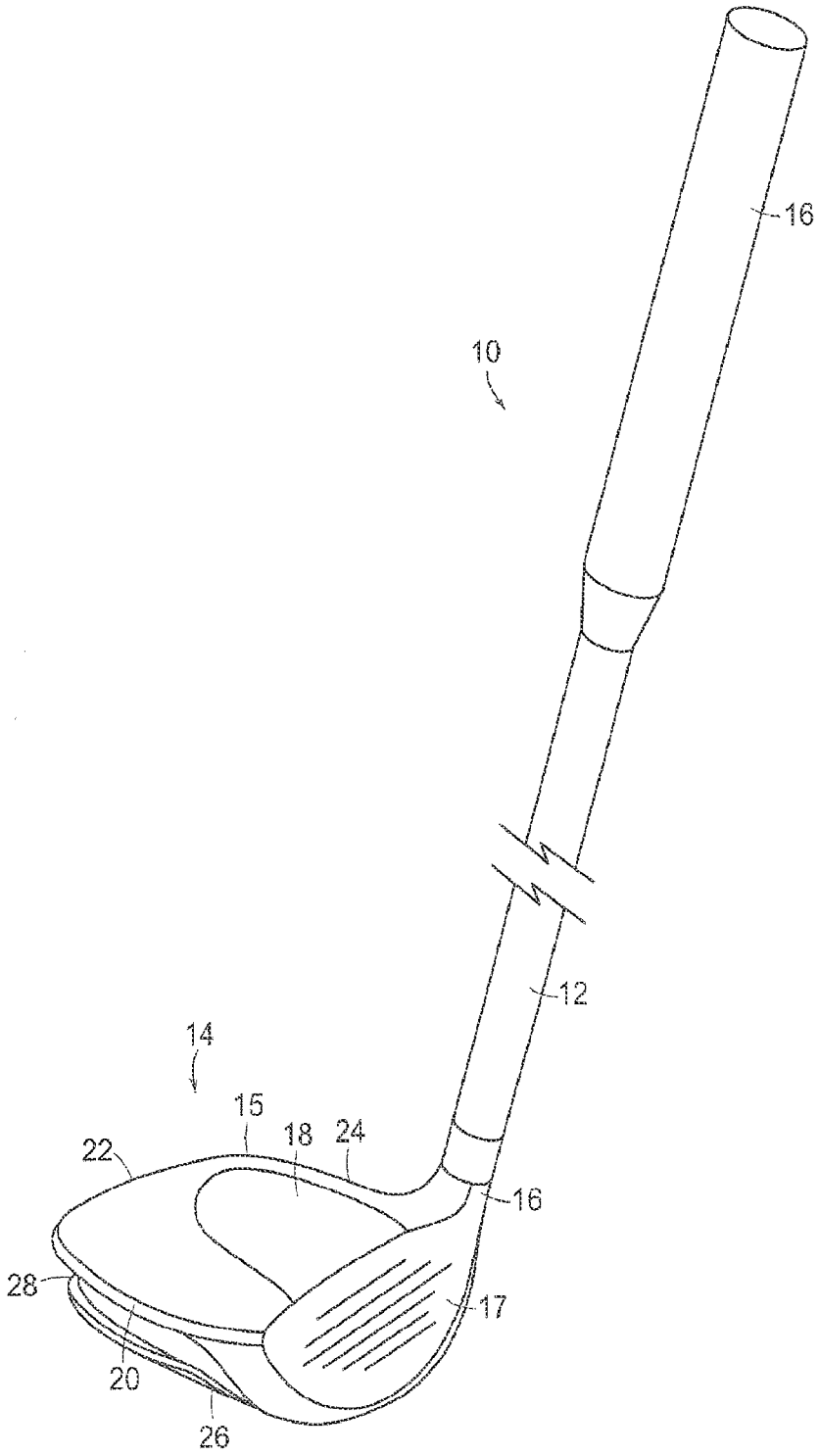
FIG. 1 is a perspective view of a golf club with a groove formed in its club head according to an illustrative aspect.

The figures referred to above are not drawn necessarily to scale, should be understood to provide a representation of particular embodiments of the invention, and are merely conceptual in nature and illustrative of the principles involved. Some features of the golf club head depicted in the drawings have been enlarged or distorted relative to others to facilitate explanation and understanding. The same reference numbers are used in the drawings for similar or identical components and features shown in various alternative embodiments. Golf club heads as disclosed herein would have configurations and components determined, in part, by the intended application and environment in which they are used.

DETAILED DESCRIPTION OF CERTAIN PREFERRED EMBODIMENTS

An illustrative embodiment of a golf club 10 is shown in FIG. 1 and includes a shaft 12 and a golf club head 14 attached to the shaft 12. Golf club head 14 may be any driver, wood, or the like. Shaft 12 of golf club 10 may be made of various materials, such as steel, aluminum, titanium, graphite, or composite materials, as well as alloys and/or combinations thereof, including materials that are conventionally known and used in the art. Additionally, the shaft 12 may be attached to the club head 14 in any desired manner, including in conventional manners known and used in the art (e.g., via adhesives or cements at a hosel element, via fusing techniques (e.g., welding, brazing, soldering, etc.), via threads or other mechanical connectors, via friction fits, via retaining element structures, etc.). A grip or other handle element 16 is positioned on shaft 12 to provide a golfer with a slip resistant surface with which to grasp golf club shaft 12. Grip element 16 may be attached to shaft 12 in any desired manner, including in conventional manners known and used in the art (e.g., via adhesives or cements, via threads or other mechanical connectors, via fusing techniques, via friction fits, via retaining element structures, etc.).

Club head 14 includes a body member 15 and a hosel 16 to which shaft 12 is attached in known fashion. Body member 15 includes a plurality of portions or surfaces. As illustrated, this example body member 15 includes a ball striking face 17, a crown 18, a toe 20, a skirt 22, a heel 24, and a sole 26. Skirt 22 is positioned opposite ball striking face 17, and extends between crown 18 and sole 26, and between toe 20 and heel 24.

A drag-reducing structure 27 is provided on body member 15 in order to reduce the drag on club head 14 during a user's golf swing from the end of a user's backswing through the downswing. Drag-reducing element 27 provides reduced drag during the entire downswing of a user's golf swing, not just at the point of impact.

At the point of impact with a golf ball, ball striking face 17 is substantially perpendicular to the direction of travel of club head 14 and the flight of the golf ball. During the user's backswing and during the user's downswing, the user's hand twist golf club 10 such that yaw is introduced, thereby pivoting ball striking face 17 away from its position at impact. With the orientation of ball striking face 17 at the point of impact considered to be 0°, during the backswing ball striking face twists away from the user toward toe 20 and skirt 22 to a maximum of 90° of yaw, at which point heel 24 is the leading edge of club head 24.

Figure 2:
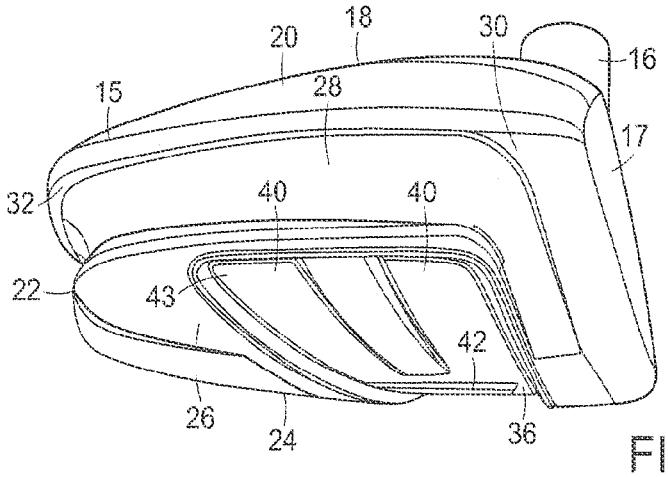
FIG. 2 is a front perspective view of the club head of the golf club of FIG. 1.
Figure 3:
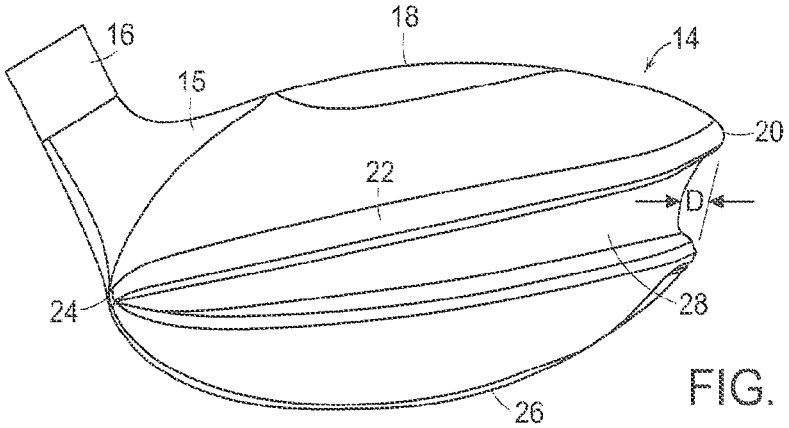
FIG. 3 is a rear perspective view of the club head of the golf club of FIG. 1.
Figure 4:
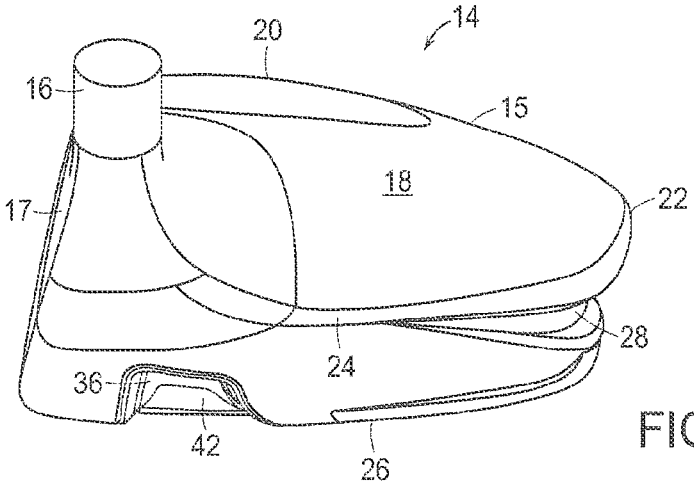
FIG. 4 is a side perspective view of the club head of the golf club of FIG. 1, viewed from a heel side of the club head.

In certain embodiments, drag-reducing structure 27 includes a continuous groove 28 formed about a portion of a periphery of club head 14. As illustrated in FIGS. 2-4, groove 28 extends from a front portion 30 of toe 20 completely to a rear edge 32 of toe 20, and continues on to skirt 22. Groove 28 then extends across the entire length of skirt 22. As can be seen in FIG. 4, groove 28 tapers to an end in a rear portion 34 of heel 24. In certain embodiments, groove 28 at front portion 30 of toe 20 may turn and continue along a portion of sole 26.

In the illustrated embodiment, groove 28 is substantially U-shaped. In certain embodiments, groove 28 has a maximum depth of approximately 15 mm. It is to be appreciated however, that groove 28 may have any depth along its length.

As air flows over crown 18 and sole 26 of body member 15 of club head 14, it tends to separate, which causes increased drag. Groove 28 serves to reduce the tendency of the air to separate, thereby reducing drag and improving the aerodynamics of club head 14, which in turn increases club head speed and the distance that the ball will travel after being struck. Having groove 28 extend along toe 20 is particularly advantageous, since for the majority of the swing path of golf club head 14, the leading portion of club head 14 is heel 24 with the trailing edge of club head 14 being toe 20, as noted above. Thus, the aerodynamic advantage provided by groove 28 along toe 20 is realized during the majority of the swing path. The portion of groove 28 that extends along skirt 22 provides aerodynamic advantage at the point of impact of club head 14 with the ball.

In the embodiment illustrated in FIGS. 1-6, body member 15 is what is known as a square head. Although not a true square in geometric terms, crown 18 and sole 26 of square head body member 15 are substantially square as compared to a traditional round head club.

An example of the reduction in drag during the swing provided by groove 28 is illustrated in the table below. In the table, drag force values are shown for different degrees of yaw throughout the golf swing for both a square head design and for the square head design incorporating the drag-reducing structure of groove 28.

| Drag Force | | | | | | |
|---|---|---|---|---|---|---|
| | Yaw | | | | | |
| | 90° | 70° | 60° | 45° | 20° | 0° |
| Standard | 0 | 3.04 | 3.68 | 8.81 | 8.60 | 8.32 |
| W/Groove | 0 | 1.27 | 1.30 | 3.25 | 3.39 | 4.01 |

It can be seen that at the point of impact, where the yaw angle is O°, the drag force for the square club head with groove 38 is approximately 48.2% (4.01/8.32) of that of the square club head. However, an integration of the total drag during the entire swing for the square club head provides a total drag force of 544.39, while the total drag for the square club head with groove 38 is 216.75. Thus the total drag force for the square club head with groove 38 is approximately 39.8% (216.75/544.39) of that of the square club head. Thus, integrating the drag force throughout the swing can produce a very different result than calculating the drag force at the point of impact only.

Figure 5:
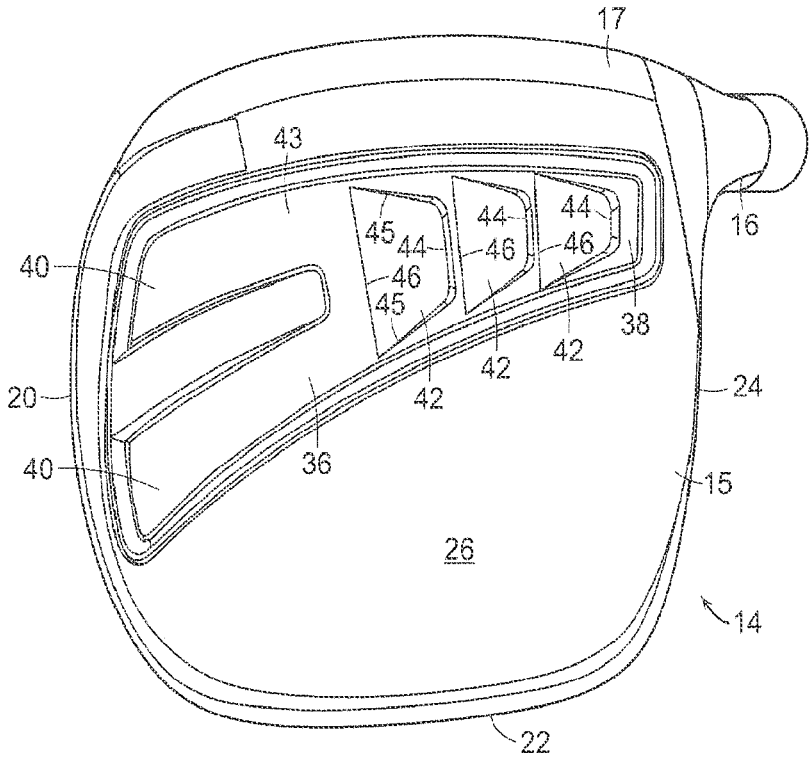
FIG. 5 is a plan view of the sole of the club head of the golf club of FIG. 1.
Figure 6:
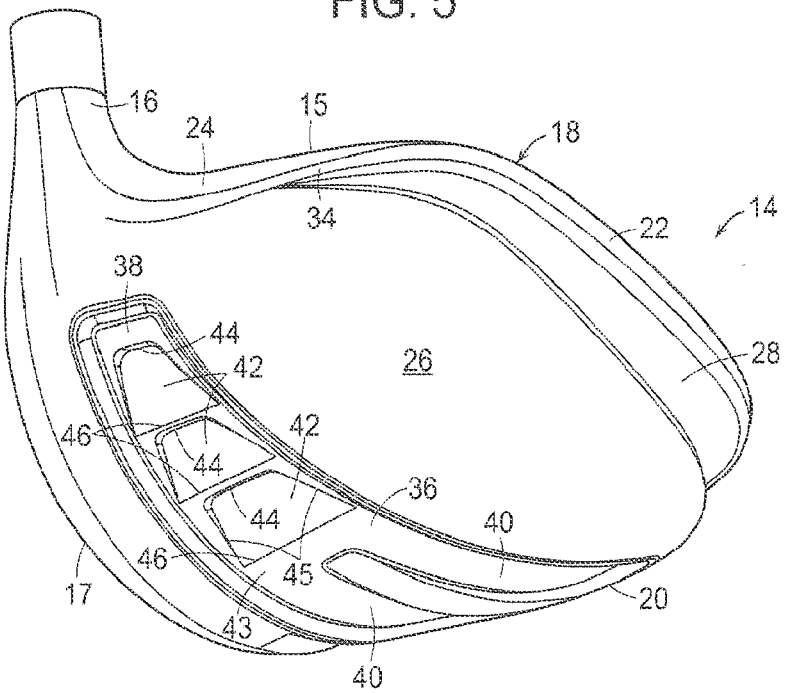
FIG. 6 is a bottom perspective view of the club head of the golf club of FIG. 1.
Figure 8:
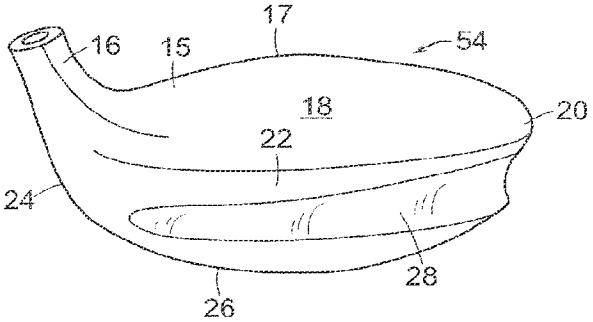
FIG. 8 is a rear perspective view of the club head of FIG. 7.
Figure 10:
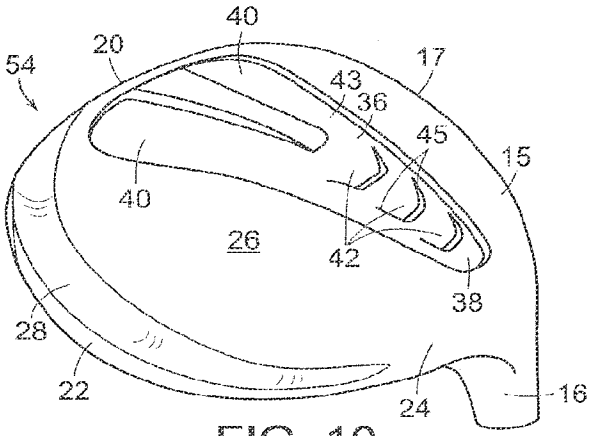
FIG. 10 is a bottom perspective view of the club head of FIG. 7.
Figure 7:
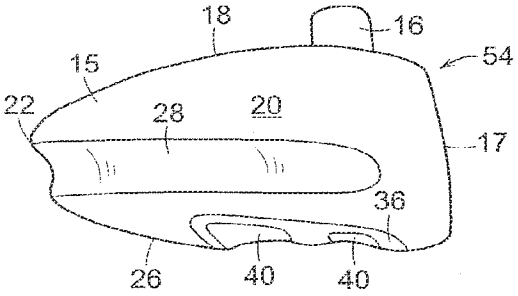
FIG. 7 is a front elevation view of an alternative embodiment of the club head of the golf club of FIG. 1.
Figure 9:
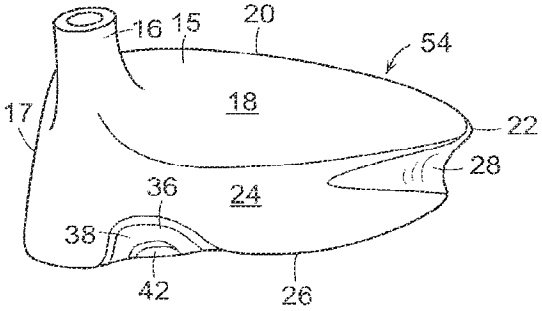
FIG. 9 is a side perspective view of the club head of FIG. 7, viewed from a heel side of the club head.

In certain embodiments, as illustrated in FIGS. 5-6, a recess 36 is formed in sole 26. In the illustrated embodiment, recess 36 is substantially V-shaped with a vertex 38 of its shape being positioned proximate ball striking face 17 and heel 24. That is, vertex 38 is positioned close to ball striking face 17 and heel 24 and away from skirt 22 and toe 20. Recess 36 includes a pair of legs 40 extending to a point proximate toe 20 and away from ball striking face 17, and curving toward skirt 22 and away from ball striking face 17.

A plurality of secondary recesses 42 is formed in a bottom surface 43 of recess 36. In the illustrated embodiment, each secondary recess 42 is a regular trapezoid, with its smaller base 44 closer to heel surface 24 and its larger base 46 closer to toe surface 20, and angled sides 45 joining smaller base 44 to larger base 46. In the illustrated embodiment a depth of each secondary recess 42 varies from its largest amount at smaller base 44 to larger base 46, which is flush with bottom surface 43 of recess 36.

Another embodiment of a club head 54 is shown in FIGS. 7-10. Club head 54 has a more traditional round head shape. It is to be appreciated that the phrase "round head" does not refer to a head that is completely round but, rather, one with a generally or substantially round profile.

Continuous groove 28 is formed about a portion of a periphery of club head 54. As illustrated in FIGS. 7-10, groove 28 extends from a front portion 30 of toe 20 completely to a rear edge 32 of toe 20, and continues on to skirt 22. Groove 28 then extends across the entire length of skirt 22. As can be seen in FIG. 4, groove 28 tapers to an end in a rear portion 34 of heel 24.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. A golf club head comprising:

a body member having a ball striking face, an upper surface, a toe, a heel, and a lower surface;

a recess formed in the lower surface;

two or more secondary recesses formed in a bottom surface of the recess, each secondary recess having:

a first base and a second base, a width that varies as the secondary recess extends from the first base to the second base, and a depth that decreases as the secondary recess extends from the first base to the second base.

2. The golf club head of claim 1, wherein the secondary recesses are arranged in a series such that a second base of a first secondary recess lies adjacent to a first base of an adjacent second secondary recess.

3. The golf club head of claim 1, wherein a first end of the recess is closer to the striking face than a second end of the recess.

4. The golf club head of claim 3, wherein the secondary recesses are arranged in a series extending in a direction from the first end of the recess to the second end of the recess.

5. The golf club head of claim 1, wherein the recess generally diverges at a first end and converges at a second end.

6. The golf club head of claim 1, wherein the secondary recesses are trapezoidally shaped.

7. The golf club head of claim 1, wherein the first base and the second base of each secondary recess extends across a width of the recess.

8. The golf club head of claim 1, wherein the sides of each secondary recess join the first base to the second base.

9. The golf club head of claim 1, wherein at least three secondary recesses are formed in the bottom surface of the recess.

10. A golf club head comprising:

a body member having a ball striking face, an upper surface, a toe, a heel, and a lower surface;

a recess formed in the lower surface; and two or more secondary recesses formed in a bottom surface of the recess, each secondary recess having a first base and a second base, wherein the secondary recesses are arranged in a series such that a second base of a first secondary recess lies adjacent to a first base of an adjacent second secondary recess, and wherein each of the secondary recesses have a depth that decreases as the secondary recess extends from the first base to the second base.

11. The golf club head of claim 10, wherein a first end of the recess is closer to the striking face than a second end of the recess.

12. The golf club head of claim 11, wherein the series of secondary recesses extend in a direction from the first end of the recess to the second end of the recess.

13. The golf club head of claim 10, wherein the recess generally diverges at a first end and converges at a second end.

14. The golf club head of claim 10, wherein the secondary recesses are trapezoidally shaped.

15. The golf club head of claim 10, wherein the first base and the second base of each secondary recess extends across a width of the recess.

16. The golf club head of claim 10, wherein at least three secondary recesses are formed in the bottom surface of the recess.

17. A golf club head comprising:

a body member having a ball striking face, an upper surface, a toe, a heel, and a lower surface;

a recess formed in the lower surface, wherein a first end of the recess is closer to the striking face than a second end of the recess; and three secondary recesses formed in a bottom surface of the recess, each secondary recess having a first base and a second base, wherein the secondary recesses extend in a direction from the first end of the recess to the second end of the recess, wherein a second base of a first secondary recess lies adjacent to a first base of an adjacent second secondary recess and a second base of a second secondary recess lies adjacent to a first base of an adjacent third secondary recess, and wherein each of the secondary recesses have a depth that decreases as the secondary recess extends from the first base to the second base.

* * * * *